US006772550B1

(12) United States Patent
Leatherwood

(10) Patent No.: US 6,772,550 B1
(45) Date of Patent: Aug. 10, 2004

(54) RIFLE SCOPE ADJUSTMENT INVENTION

(76) Inventor: James Milner Leatherwood, Box 140, Lingleville, TX (US) 76461

( * ) Notice: Subject to any disclaimer, the term of this patent is extended or adjusted under 35 U.S.C. 154(b) by 0 days.

(21) Appl. No.: 10/351,011

(22) Filed: Jan. 25, 2003

(51) Int. Cl.[7] ..... F41G 1/38
(52) U.S. Cl. ..... 42/119; 42/122; 33/246; 33/248
(58) Field of Search ..... 42/119, 122, 133; 33/246, 247, 248

(56) References Cited

U.S. PATENT DOCUMENTS 2,150,629 A * 3/1939 Mossberg ..... 356/247
4,247,161 A * 1/1981 Unertl, Jr. ..... 359/424
4,389,791 A * 6/1983 Ackerman ..... 42/122

* cited by examiner

*Primary Examiner*—J. Woodrow Eldred

(57) ABSTRACT

A vertical adjustment mechanism for weapon's sights such as riflescopes that includes moveable indicator flags for indicating zeros at various ranges. These flags can be moved independently and are separated by spacers that are keyed to the central shaft in to prevent the movement of one flag from disturbing the setting of the other flags. The adjustment also includes a graduated dial that indicated angular change in the adjustment to facilitate the setting of the indicator flags and to provide a zero point for orienting the system. Once adjusted, the entire assembly is locked together by tightening screws that clamp the separate pieces together so it will function as if it was a single unit. The adjustment mechanism can be applied to the internal components of a telescopic sight or to an external mount.

2 Claims, 3 Drawing Sheets

RIFLE SCOPE ADJUSTMENT INVENTION

BACKGROUND OF THE INVENTION

1. Field of the Invention

The present invention relates to vertical adjustment devices for telescopic weapon's sights and telescopic sight mounts.

2. Description of the Prior Art

For at least a century, pre-calibrated vertical adjustment systems have been used on telescopic rifle and other weapon sights to allow the user to set a pre-determined correction for the ballistic path of the weapon's projectile. The problem with this approach is that once calibrated the dial or disk or other display system cannot be altered except by replacement with another dial or disk. Even then it is impossible to accommodate the almost infinite number of potential ballistic paths. This system has been used for both internal and external adjustment systems and has changed little in basic design since the early 1900's.

SUMMARY OF THE INVENTION

The object of the present invention is to provide a vertical adjustment device with means for an infinite number of settings and to be readily adjustable by the user.

Another object is to enable the user to make the necessary settings either by actual shooting or from mathematically determined data.

Still another object is to provide a means of setting the individual range markers without disturbing the settings of adjacent range markers.

These and other objects will become apparent from the following description and the accompanying drawings. For a better understanding of this new and important improvement to vertical adjustment system for riflescopes, reference should be made to the accompanying drawings and descriptive matter in which there are illustrated preferred embodiments of the invention.

DESCRIPTION OF THE PREFERRED EMBODIMENTS

Figure 1:
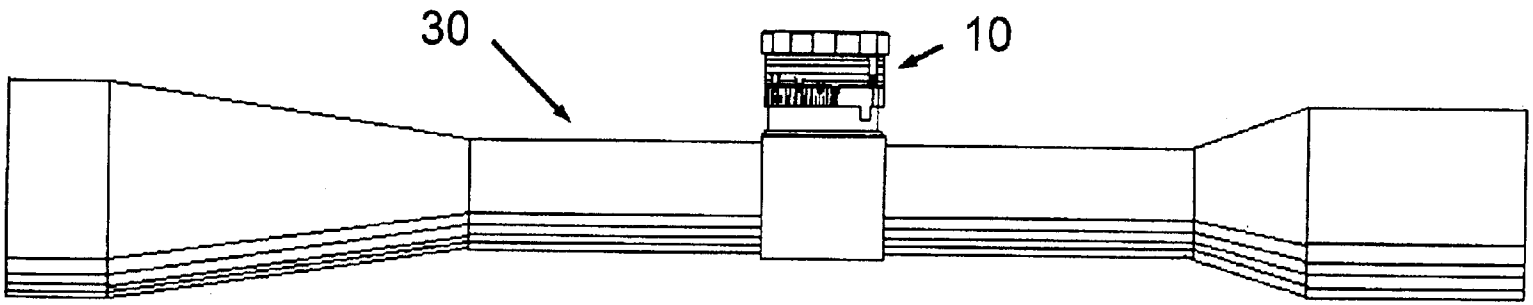
FIG. 1 is a side view of the adjustment device according to the invention incorporated in a telescopic rifle sight.
Figure 2:
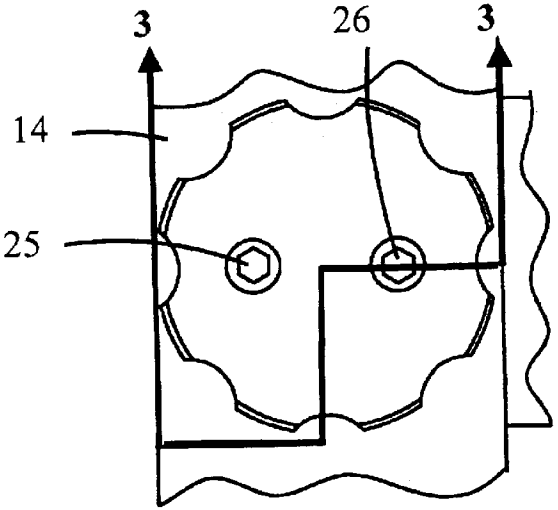
FIG. 2 is a top view of the adjustment device showing the section for FIG. 3.
Figure 3:
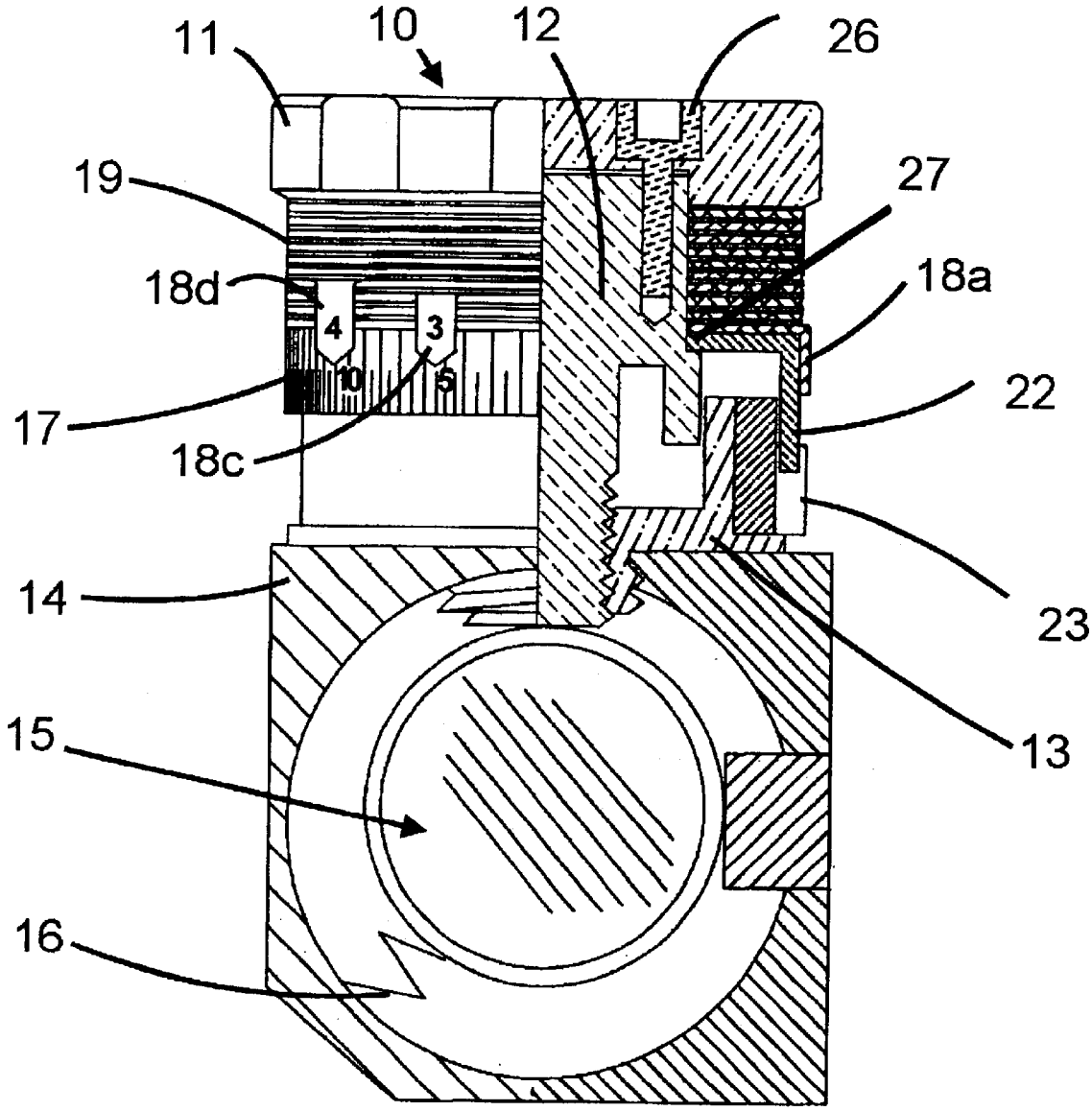
FIG. 3 is a partial sectional view showing the principal components taken along 3—3 of FIG. 2.

FIG. 1 shows the invention as an embodiment in a riflescope 30. FIG. 3 shows a sectional view along path 3—3 shown on FIG. 2. The adjustment assembly 10 contains a finger knob 11 that the user turns to change the zero range of the telescopic sight. The knob 11 is directly attached to a shaft 12 that is in controlled engagement with a housing 13 that is attached directly to the body of the riflescope 14.

The internal optical assembly 15 containing some of the rifle scope's optical elements is urged against the end of this shaft 12 by a spring 16 in the scope body 14. Movement of the optical assembly 15 causes the optical path to move and thereby alters the optical image's relationship to the rifle in a manner well known in the art to adjust the aim of telescopic sights. Moving shaft 12 by rotating the knob 11, causes the optical element assembly 15 to change the line of sight accordingly.

Again referring to FIG. 3, this sectional view shows the shaft 12 and the graduated ring 16 that is capable of rotating about the shaft 12. Above the graduated ring 16 are an alternating series of plates that are of two types. One type 18*a–j* carries an indicator or flag that is numbered according to the range that it will indicate. The other type is a spacer 19 that separates the flag indicator plates 18*a–j*. Although the lengths of the flags may vary according to the range they indicate, the function is the same for all of the flag indicator plates 18*a–j*. The spacer plates 19 are all identical and function to separate the flag indicator plates 18*a–j* and keep the movement of one such as 18*b* from also moving a flag indicator plates 18*c* or 18*a* above or below its position.

Figure 4:
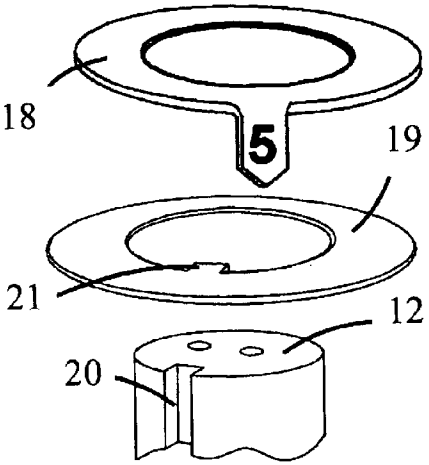
FIG. 4 is a perspective view of a representative indicator plate, spacer and the main adjusting shaft.

To understand how they perform this function, please refer to FIG. 4. FIG. 4 shows a perspective view of shaft 12, spacer 19 and flag indicator plate 18*e*. A vertical slot 20 is cut in shaft 12. As shown in the perspective view in FIG. 4, the spacer plates 19 each have a key 21 that engages the slot 20. This prevents the spacer plates 19 from being able to rotate about shaft 12. Consequently the rotational motion of one of the flag indicator plates 18*a–j* cannot be transmitted to an adjacent flag indicator plate 18*a–j* through the rotation of the spacer plates 19.

This allows the user to set the flags on indicator plates 18*a–j* independently and not have a flag on indicator plates 18*a–j* disturbed by the setting of the other indicator plates 18*a–j*.

To provide a means of referencing the rotation of the adjustment dial in terms of the amount of change between the line of sight and the trajectory path of the weapon's projectile path, the graduated ring 16 can be rotated about the axis of the adjustment to provide a reference scale.

Once the closest zero position has been established, the graduated ring 16 is set with its stop 22 against the stop 23 located on the adjustment assembly. The closest range zero flag on indicator plate 18*a* is set to the reference line 24. Then the other indicator plates 18*b–j* can be set to their appropriate positions either by actual shooting or using the graduated ring 16 as a reference for the amount of angular change needed for a zero at the various ranges. Once all the flags on the indicator plates 18*a–j* are set to their positions then the entire assembly is locked together as a single unit by tightening screws 25 and 26. This squeezes the graduated ring 16, the spacers 19 and the graduated ring between the shoulder 27 on the shaft 12 and the finger knob 11. Now the adjustment assembly 10 acts as if it was a one-piece adjustment.

Figure 5:
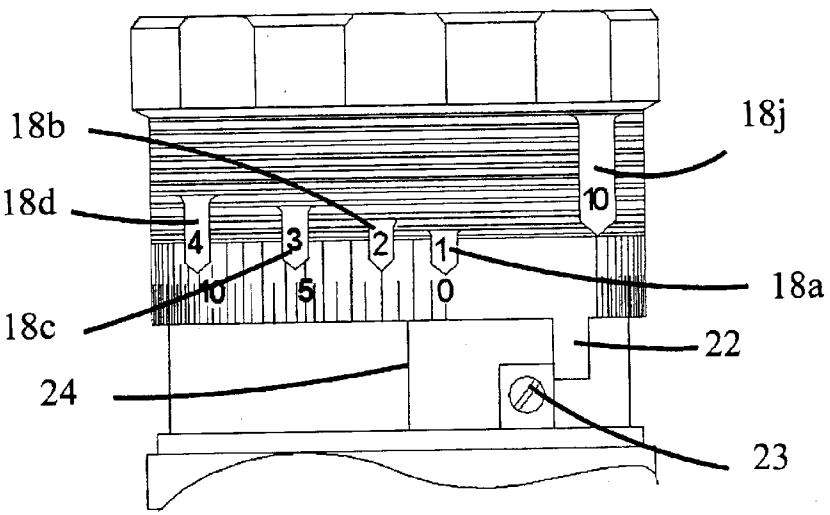
FIG. 5 is a view of the rear of the adjustment device, as it would be seen during use of the riflescope.

To correct the line of sight to the various ranges, the user simply aligns the appropriate range flag on one of the indicator plates 18*a–j* with the index mark 24 as shown in the rear view shown in FIG. 5.

Figure 6:
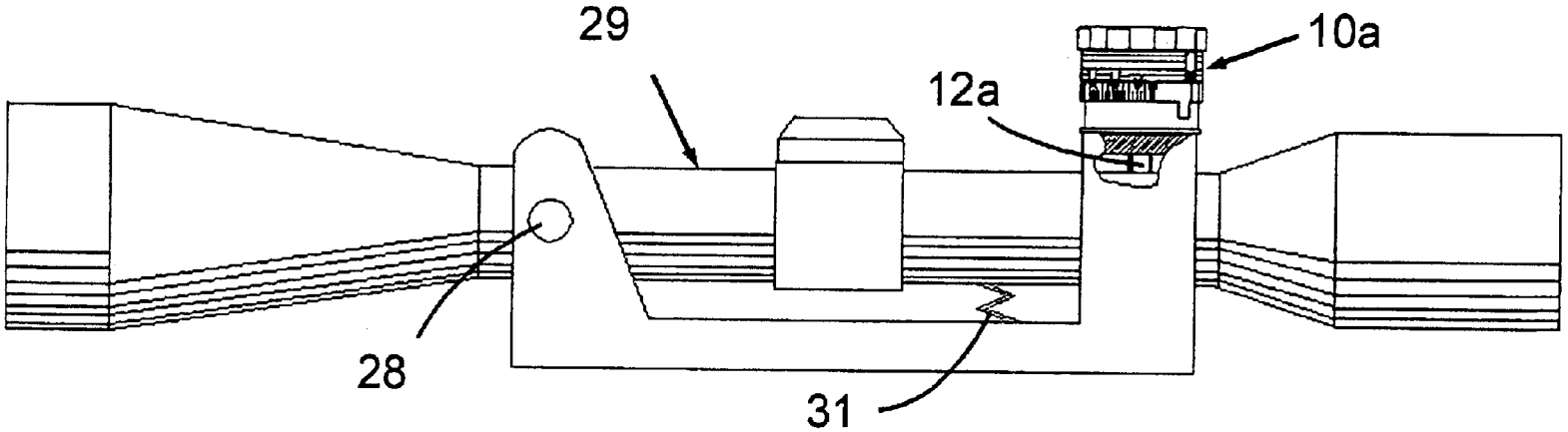
FIG. 6 is a side elevation view of an embodiment of the invention in a riflescope mount.

FIG. 6 shows the embodiment of the invention in an external mount system. This form of the invention 10*a* is essentially the same as the internal application in novel features. As shown in this view the entire scope is pivoted about an axis 28 and a spring means 31 forces the scope 29 against shaft 12*a*.

In this case, shaft 12*a* now moves the entire scope assembly instead of the internal optical component in a manner also well know in the art to adjust the aim of telescopes.

The invention is not limited to the exemplary constructions herein shown and described, but may be made in various ways within the scope of the appended claims.

I claim:

1. In a vertical adjustment means for a telescopic rifle sight, a set of independently moveable indicator means capable of rotation about a central adjusting shaft and a locking means for securing said indicator means to said shaft.

2. The adjustment means of claim 1 in which the said indicator means are separated by a spacer means keyed to said central shaft.

* * * * *